US006397545B1

(12) United States Patent
Fanucci et al.

(10) Patent No.: US 6,397,545 B1
(45) Date of Patent: Jun. 4, 2002

(54) ENERGY-ABSORBING UTILITY POLES AND REPLACEMENT COMPONENTS

(75) Inventors: Jerome P. Fanucci; James J. Gorman, both of Woburn, MA (US)

(73) Assignee: KaZak Composites, Inc., Woburn, MA (US)

( * ) Notice: Subject to any disclaimer, the term of this patent is extended or adjusted under 35 U.S.C. 154(b) by 0 days.

(21) Appl. No.: 09/539,168

(22) Filed: Mar. 29, 2000

Related U.S. Application Data

(60) Provisional application No. 60/126,577, filed on Mar. 29, 1999.

(51) Int. Cl.[7] ..... E04H 12/00; E04C 3/36

(52) U.S. Cl. ..... 52/514; 52/40; 52/301; 52/514.5; 52/726.3; 52/726.4; 52/736.1; 52/741.14; 52/745.18

(58) Field of Search ..... 52/301, 296, 297, 52/726.3, 726.4, 736.1, 736.3, 736.4, 737.3, 737.4, 741.14, 745.17, 745.18, 514, 514.5, 40, 98, 170; 174/45 R

(56) References Cited

U.S. PATENT DOCUMENTS

| | | | | | |
|---|---|---|---|---|---|
| 1,846,682 | A | * | 2/1932 | Hammel | 52/726.4 X |
| 3,574,104 | A | * | 4/1971 | Medler | 174/45 R X |
| 3,755,977 | A | | 9/1973 | Lewis | |
| 3,853,418 | A | | 12/1974 | Druin et al. | |
| 3,911,548 | A | * | 10/1975 | Perry | 52/40 X |
| 3,987,593 | A | * | 10/1976 | Svensson | 52/736.3 X |
| 4,033,080 | A | * | 7/1977 | Fukushima | 52/514 X |
| 4,048,779 | A | * | 9/1977 | Valenziano et al. | 52/726.4 |
| 4,066,372 | A | * | 1/1978 | Swanson et al. | 52/40 X |
| 4,092,079 | A | * | 5/1978 | Swanson | 52/296 X |
| 4,432,172 | A | | 2/1984 | Kuykendall et al. | |
| 4,492,496 | A | * | 1/1985 | Arnold | 52/40 X |
| 4,803,819 | A | | 2/1989 | Kelsey | |
| 4,920,715 | A | | 5/1990 | Parsons et al. | |
| 4,991,367 | A | * | 2/1991 | McGinnis | 52/170 |
| 5,060,437 | A | | 10/1991 | Parsons et al. | |
| 5,222,344 | A | * | 6/1993 | Johnson | 52/736.4 |
| 5,337,469 | A | * | 8/1994 | Richey | 52/514 X |
| 5,513,477 | A | * | 5/1996 | Farber | 52/726.4 |
| 5,529,276 | A | | 6/1996 | Szablya | |
| 5,555,696 | A | | 9/1996 | Morrison, III et al. | |
| 5,556,673 | A | * | 9/1996 | Giraud | 428/34.4 |
| 5,704,187 | A | | 1/1998 | Hosford et al. | |
| 5,749,182 | A | | 5/1998 | Vavrinak | |
| 5,819,494 | A | * | 10/1998 | Haisch | 52/713 X |

FOREIGN PATENT DOCUMENTS

| | | | | |
|---|---|---|---|---|
| CH | 85637 | * | 7/1920 | 52/296 |

OTHER PUBLICATIONS

AB SALA BYGGNADSSMIDE, "The ESV Column for Safer Traffic", May 1976.*

* cited by examiner

*Primary Examiner*—Laura A. Callo
(74) *Attorney, Agent, or Firm*—Weingarten, Schurgin, Gagnebin & Lebovici LLP

(57) ABSTRACT

Energy-absorbing utility poles and replacement components comprising a composite material laminate are provided. In one embodiment, the poles of the present invention are designed to bring an impacting vehicle to a controlled stop. It is intended that the products of the presently claimed invention be formed using a pultrusion process that results in a pole having low to moderate diametric crush strength, so as to initiate a flattening and then folding response as the vehicle encounter, the pole. One of the critical features of the present invention is the provision of a socket/slip joint enabling connection of a composite lower section with a wooden upper section such that the connection securely joins the two elements during ordinary conditions, but releases when either the upper or lower element experiences force greater than a predetermined value, as where the pole is struck by a vehicle. With a fixed rather than slip joint, a hybrid pole system with safety features between a standard wooden or other conventional pole and the slip-joint system would be created with many of the same cost advantages.

23 Claims, 9 Drawing Sheets

ENERGY-ABSORBING UTILITY POLES AND REPLACEMENT COMPONENTS

This application claims the benefit of provisional application 60/126,577, filed Mar. 29, 1999.

FIELD OF INVENTION

The present invention relates generally to utility poles that are capable of absorbing impact energy, as from a motor vehicle collision, thereby reducing the effects of the impact on the vehicle and its occupants. The utility poles of the present invention are constructed so as to enable ease of conversion and replacement of currently installed poles.

BACKGROUND OF THE INVENTION

Wood, specifically tree trunks impregnated with creosote and other chemicals, is currently the most widely used material for utility poles. It is estimated that at least 114 million wooden poles are currently in service in the United States alone. A wooden pole is very durable, nonconductive, and amendable to a wide variety of methods for attachment of overhead wires. One of the major advantages of wooden poles is the low cos:t of the basic pole, approximately $250 for a 40-foot tall, 11-inch diameter Class 3 pole. In addition, wooden poles are well understood by utility companies and other users of pole-supported systems, and are accepted by the general population as a necessary component of various wire and cable distribution systems.

However, wooden utility poles do have several drawbacks. First, wooden poles must be chemically treated to prevent insect attack, a process that creates both current problems with hazardous material disposal at the manufacturing site and future problems with disposal of the treated poles once they are taken out of service. Second, the chemical treatment does not guarantee that the pole will not be damaged by insect attack or rot, another major contributing cause of pole failure. Third, the weight of a wooden pole can complicate installation in areas that are not easily accessible for truck-mounted cranes and other installation equipment. Finally, one of the major problems with wooden utility poles is their unforgiving nature when they are involved in a vehicle accident.

United States Department of Transportation (DOT) regulations require that most roadside equipment be designed to have breakaway or other safety features that limit vehicle decelerations caused by impact with the equipment in an accident. However, wooden utility poles are one major exception to this rule, primarily because no technically and economically viable alternative to the wooden pole has been identified.

Although some investigation of methods for incorporating breakaway features into wooden pole designs have been conducted in the past, the expense associated with the incorporation of breakaway devices into wooden poles has prevented the widespread application of this technology. In addition, it is not obvious that a breakaway pole made from any material would significantly increase the overall public safety. It can be argued that a vehicle that passes through a breakaway pole with minimum deceleration is very likely to impact a tree, building, or other less forgiving obstacle a short distance past the "safe" pole, while still moving at considerable speed.

DOT has postulated that a much more desirable and safer system would involve a utility pole that could bring a vehicle to a stop by collapsing in a controlled fashion during an automobile impact, or at least could safely remove a significant portion of the vehicle's energy during its dynamic interaction with the pole. A steel luminaire having these general characteristics has been demonstrated in Sweden. However, the cost of manufacturing such poles, and their conductivity, make their widespread use, particularly to carry overhead wires, impractical.

Thus, use of more modem composite materials in place of wood or steel to produce energy-absorbing utility poles is highly desirable. Composite materials have already proven to be capable of making technically-acceptable utility poles that meet normal day-to-day operational requirements. However, current composite poles act as breakaway devices rather than energy absorbing devices. Thus, current composite poles do not provide the safety features desired during a vehicular collision.

The potential market for repair/replacement poles is very large. It has been estimated that approximately 4% of the installed poles, or 4.5 million units, are replaced annually. If the approximate retail cost of a replacement composite energy absorbing pole were as little as $300 each, then this market would exceed $1.35 billion annually. To date, that market has not been developed. Composite poles are currently used in special applications that can justify their higher installation cost, as compared to wood. However, because composite poles made using current technology are generally two to four times more expensive to purchase than an equivalent wood pole, the market acceptance of composite poles has been greatly limited.

For these reasons, the ideal utility pole would possess the following general characteristics. First, it should have the ability to absorb impact energy and induce the safe deceleration of an impacting vehicle while greatly reducing the existing velocity of the vehicle, as compared to a breakaway design. Second, it should be manufactured from nonconductive material suitable for use in carrying utility wires. Third, it should be able to be produced, installed, and maintained at a cost that encourages utility companies to employ the new pole technology as the standard equipment. Fourth, it should be capable of being used as a replacement component of a composite/wood hybrid pole. Fifth, it should reduce the problems associated with hazardous material disposal both during manufacture and on later disposal of the spent equipment.

BRIEF SUMMARY OF THE INVENTION

Accordingly, it is an object of the present invention to provide a utility pole that is capable of absorbing impact energy and inducing a safe deceleration of an impacting vehicle, as compared to a breakaway design.

It is another object of the present invention to provide a utility pole that can be produced, installed, and maintained at a cost that encourages utility companies to employ the new pole technology as the standard equipment.

It is a still further object of the present invention to provide a utility pole that capable of being used as a replacement component of a hybrid pole.

It is yet another object of the present invention to provide a utility pole that reduces the problems associated with hazardous material disposal both during manufacture and on later disposal of the spent equipment.

The present invention provides energy-absorbing utility poles and replacement components. In one embodiment, the poles of the present invention are designed to bring an impacting vehicle to a controlled stop. Analysis of crash energetics in combination with proven energy absorption capacities indicate that composite pole weights of between 100 and 400 lbs. For a twenty-five foot long replacement pole should provide safe vehicle stops for a wide range of vehicle encounters (1800 to 3600 lbs. at 60 mph).

In a further embodiment, the poles of the present invention are capable of use as a field-replaceable component for an existing, damaged wooden pole to form a hybrid pole system. In this embodiment, a previously installed but damaged conventional wooden pole may be sectioned below the lowest overhead service attachment to form an upper and a lower section, with the old upper wooden section being retained with all previously attached hardware and inserted into a new lower section comprising a pole of the present invention in combination with a slip joint or permanent connection.

In a new installation, this wood/composite hybrid can be assembled offsite at a factory and installed just like a conventional new pole.

In one embodiment, the products of the presently claimed invention are formed using a pultrusion process that result in a pole having low to moderate diametric crush strength so as to initiate a flattening and then folding response as the vehicle encounters the pole. The pultrusion process comprises a wet bath resin impregnation of a fiber preform incorporating reinforcing materials (dry unidirectional fibers, cloth, multi-axial stitch bonded materials, braided preforms, and specially produced 2D and 3D reinforced materials) that are continuously pulled from spools or woven in-line prior to being passed through an optional preheating furnace, which dries the materials and improves resin wet-out, and then passed through several forming cards before introduction into a one-meter long heated steel die, which compacts the material into the final geometry against a cantilevered, free-floating mandrel. In an optional embodiment, the liquid resin matrix may be injected directly into the die.

Pultrusion differs considerably from filament winding technology used by current producers of composite poles. Most significantly, pultrusion can make poles as a continuous stream as quickly as 3 feet per minute. In comparison, other composite pole manufacturing systems make poles one at a time, requiring much greater labor input, larger capital investment, and longer processing time and producing much more scrap.

The utility poles of the present invention may be made either as stand-alone units or as replacement components, wherein a damaged existing pole would be sectioned below the lowest service attachment, forming a lower, damaged section and an upper, functional section; the lower, damaged section removed and replaced with a pole base component of the present invention; and the upper, functional section of the original pole assembled with the replacement base component. An advantage of this operation is the ability to retain intact all of the service connections to the upper section of the damaged pole during the transfer to the replacement pole base. This eliminates the need for multiple visits by the various utilities using the pole to transfer the wires from the damaged pole to the replacement pole. Typically, the upper section of the damaged pole is secured to the bucket of a bucket truck: prior to sectioning the damaged pole and then released once the upper section is attached to the replacement pole.

DESCRIPTION OF THE FIGURES

Other aspects and advantages of the present invention will be apparent upon consideration of the following detailed description hereof which includes numerous illustrative examples of the practice of the invention, with reference being made to the following figures.

DETAILED DESCRIPTION OF THE INVENTION

Figure 1:
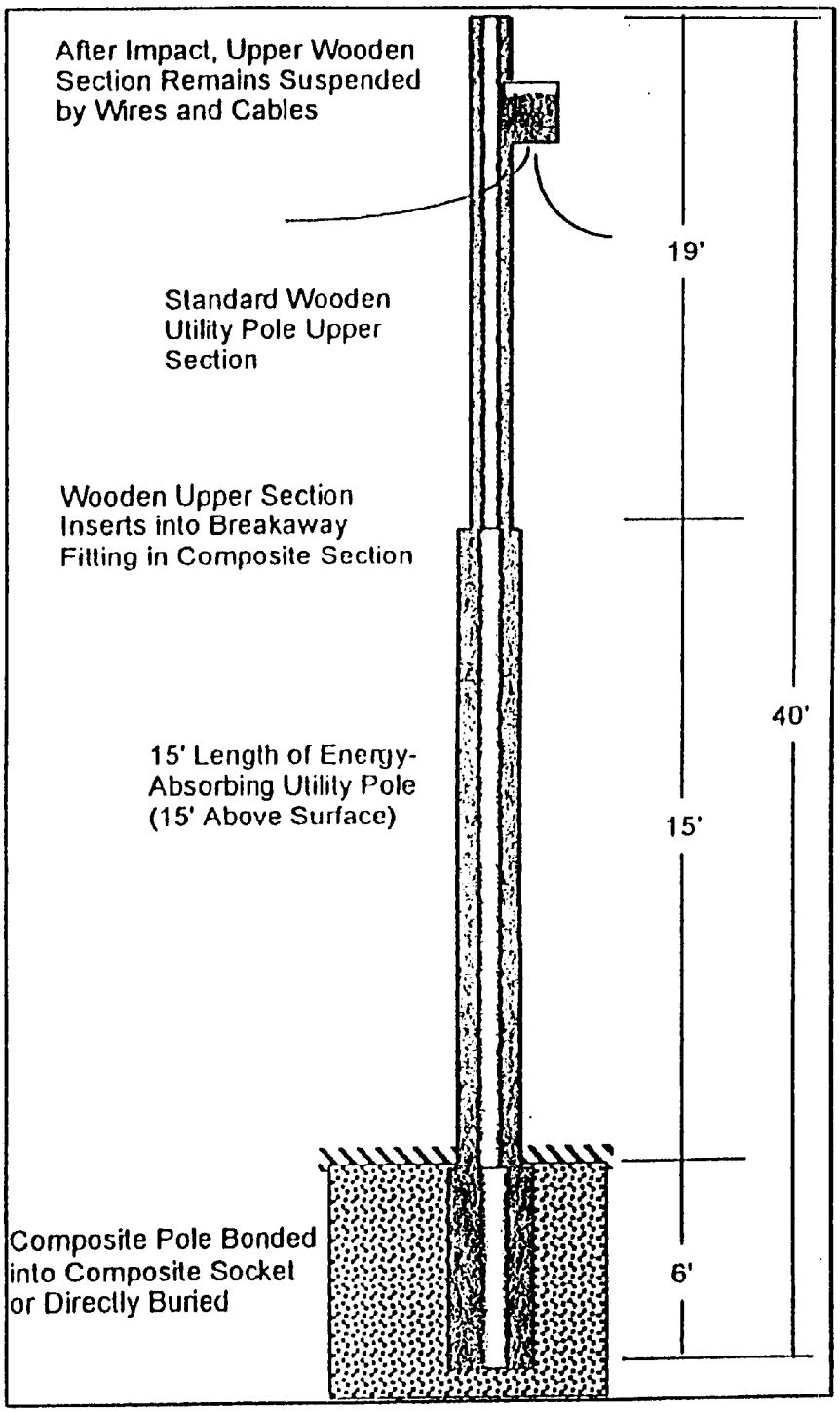
FIG. 1 shows a schematic view of one embodiment of the hybrid composite/wood pole of the present invention.

The present invention relates to the design and production of energy absorbing utility poles, made with a composite material laminate tailored to bring an impacting vehicle to a controlled stop. The present invention further relates to a means of installing the new composite pole in a way that makes it a less costly alternative than wood over the pole's useful life. This life cycle cost savings will be gained by a significant reduction in material and installation costs associated with use of the products of the present invention in a repair/replacement scenario. It is projected that, despite the fact that a composite pole of the present invention will still cost more per foot to produce than a wooden pole, it will be less expensive to install and maintain over its useful life.

A process for using a composite pole of the present invention as the major component in a much lower cost system for repairing or replacing existing poles has been developed. A vast majority of pole replacements occur because of damage to the lower section. In its simplest embodiment, an existing, damaged wooden pole would be cut off approximately 15 feet above the ground, at a height just below the lowest wires. The lower section of the existing wooden pole would then be removed and discarded. The new, hollow composite pole would then be slipped over the retained upper wood section, and the entire assembly dropped into the original hole left in the ground after removing the original wooden base.

The major cost savings able to be realized with this system comes from eliminating the need for transferring wires from an old to a new upper wooden pole. This operation has historically been the most expensive and time consuming part of the installation process, requiring many trips to the pole by the various services using the pole to carry overhead wires.

In addition, as part of the current wooden pole repair process, the old and new poles must be cross-braced together for a period of days or weeks while the wires are transferred from the old to the new pole by each distributor using the pole. The period when the two poles are so situated has been the source of a great number of complaints to the utility pole owners, since many people view the double pole as an eyesore and/or a safety hazard. Indeed, some municipalities have placed restrictions on the number of so-called "double poles" that may be in place at any one time.

The proposed system of eliminating the wire transfer step eliminates the need for a period with dual poles. It also greatly reduces the time required to change poles, reducing the number of crew trips to the site from a minimum of two, and often considerably more, to just one, with obvious cost savings. This system also cuts the acquisition cost of the composite pole approximately in half compared to existing composite poles, because considerably less than a full pole-height (typically 20–25 feet) of composite pole is required for a typical replacement installation.

One of the features of the present invention is the provision of a hybrid pole in which a composite lower section is combined with a wooden upper section through a socket/slip joint. Such hybrid poles may be constructed as a unit prior to installation of the pole, or subsequent to installation of a conventional wooden pole by sectioning the wooden pole below the lowest cross-member to form an upper section and a lower section, discarding the used lower section, replacing it with a pole of the present invention, and fitting the upper section into the replacement lower section.

Once installed, if the lower composite section of the pole is struck by an errant vehicle, it will separate from the upper wooden section while crushing and folding in a manner designed to slow the vehicle safely. Normally installed wires connecting adjacent poles will support the released upper section carrying the utility cables. These wires also provide sufficient restraint to the upper section of the pole to facilitate separation of the composite lower section. After a crash even e lower section of the pole can be easily replaced and the free-hanging wood upper section re-attached to the new composite lower section. This procedure eliminates the time and expense of transferring wires from an older, damaged pole to its replacement, It further reflects the reality that most utility pole replacements are due to either rot or impact damage near the line of the grade, while the upper sections remain quite serviceable.

The following examples illustrate practice of the invention. These examples are for illustrative purposes only and are not intended in any way to limit the scope of the invention claimed.

EXAMPLE 1

Several composite pole constructions have been developed. These composite constructions are illustrated in FIG. 2, and include:

1. A conventional +/−Θ filament-wound or -braided construction typical of current composite poles and light standards.
2. A combination of highly unbalanced +/−Θ wrapping with a few large axial tows to provide longitudinal integrity.
3. A balanced +/−Θ wrapping with a few large longitudinal tows.
4. A highly unbalanced +/−Θ "slinky" construction.

The objective of these constructions is to provide a pole with low to moderate diametric crush strength so as to initiate a flattening and then folding response as the vehicle drives over it, while maintaining axial bending stiffness and strength required for normal use.

Figure 2:
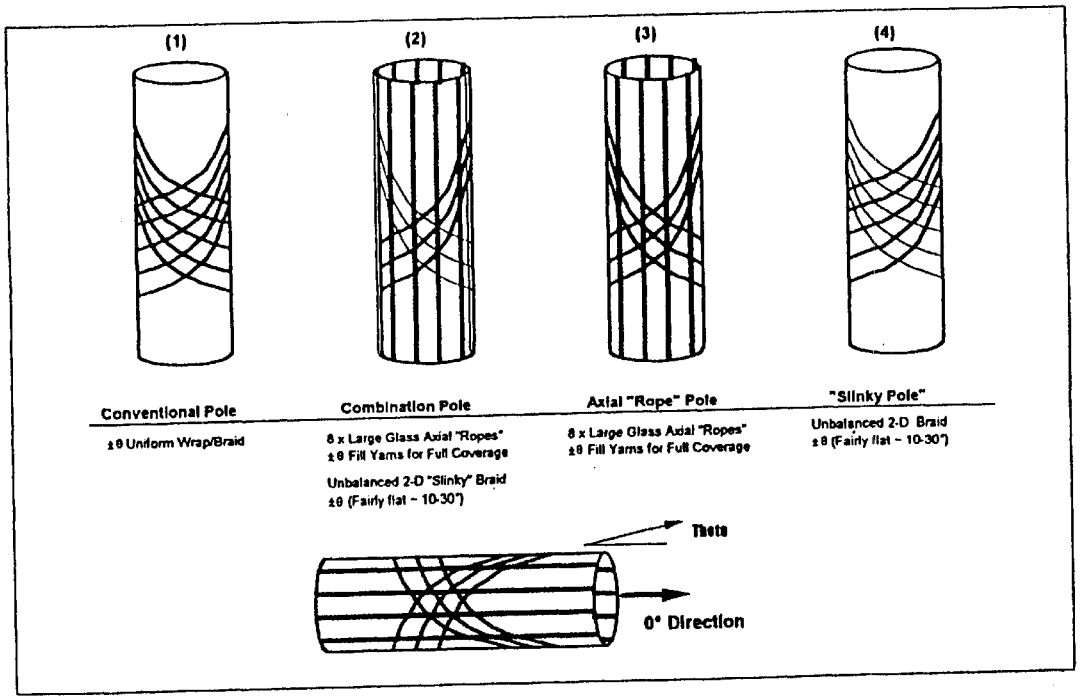
FIG. 2 shows a schematic view of several utility pole composite constructions.

Three sub-scale (1:5) models were fabricated for each of the composite pole constructions illustrated on FIG. 2. These models were two inches in diameter by 6 feet long with wall thickness of approximately 0.075". The specimens were fabricated via braiding of E-Glass/polyester with an oven cure.

In order to test the sub-scale pole models, a benchtop facility was constructed having a spring launcher and solenoid release to drive a vehicle model at the test pole with a velocity of 30 mph. The pole model was set into a bucket of packed sand whose upper surface was flush with the tabletop. A spring assembly was stretched to contain sufficient stored energy to accelerate the ~15 pound test model to 30 mph. A solenoid was then actuated to release the vehicle model to strike the pole. Tethers on the vehicle model attached to hydraulic shock absorbers prevented the model from running over the table surface to collide with the back wall. Video coverage was shot of all tests both to provide a record of these efforts and to help deduce the model vehicles' impact velocities. A test velocity of 30–31 mph was consistently obtained with trials on PVC pipe and the actual model pole experiments.

In a typical test, the crushing collapse mode of the pole wall at the moment of impact, a desirable initial response to impact, could be clearly seen. The results of one of the impact tests on a Type 3 pole (see FIG. 2) showed that the pole was still attached at ground level, and was flattened and folded for some 6 inches of its length (30 inches or so in full scale). This response indicates good energy absorption in the composite. Constructions of Type 2 and 3 exhibited desirable crushing & folding behavior, while the others provide higher initial forces and more localized damage.

Significant differences in deceleration load and energy absorption capacity were observed in the distinct composite pole impact responses.

These results provide strong evidence that a "safer" utility pole can be designed and manufactured, having handling properties and life cycle costs very attractive to the public utilities that purchase these poles.

Pultrusion Manufacturing Background

A variety of different methods have been developed for production of composite structures. These processes vary in their ability to develop maximum mechanical properties in the composite, in the structural configurations that are appropriate for the individual production technologies, in cost of raw materials used in each process, and in the amount of labor required to produce a part.

Processes that use prepreg generally produce the highest quality hardware. Prepreg layup followed by autoclave cure is the standard manufacturing method for load-bearing structures in the aerospace composites industry. This technique is capable of making very high quality structures of almost any geometry. Unfortunately prepreg layup is the most expensive way to produce composite hardware because of its low throughput, high labor content, and high cost of raw materials.

The opposite extreme of the composite manufacturing process spectrum, both from the production cost and mechanical performance points of view, includes a wide variety of techniques that are best suited for the construction of low cost, lightly loaded parts designed primarily for appearance. Examples of these techniques include reaction injection molding (RIM), chopped fiber spray-up processes and the use of sheet molding compound (SMC). Typical characteristics of these processes include their low cost and rapid cycle time. However, the low percentage of reinforcing fiber in the resulting composite and the lack of well-controlled fiber orientation results in structures that are not well-suited for primary or sometimes even secondary load-bearing applications. Typical examples of products appropriate for these methods include automobile body panels, commercial and decorative structures, and boat hulls.

Figure 3:
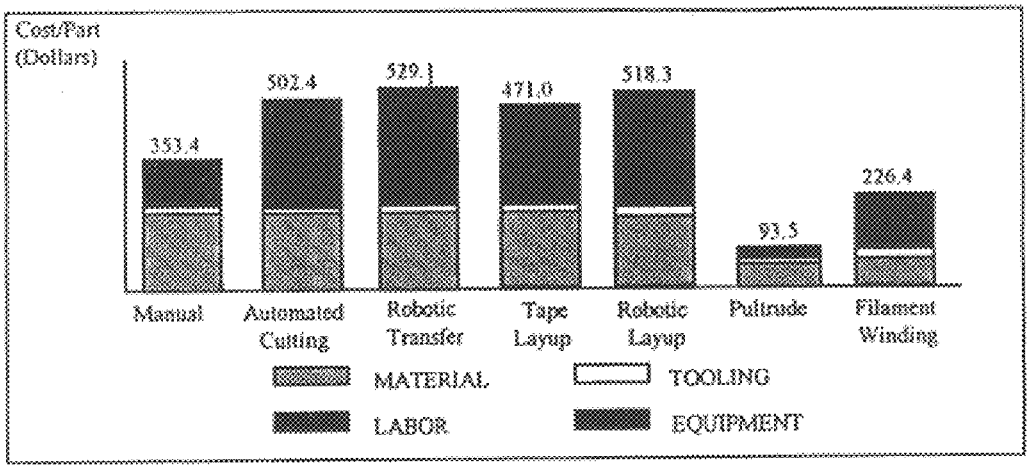
FIG. 3 shows a graphical comparison of composite production technology costs.
Figure 4:
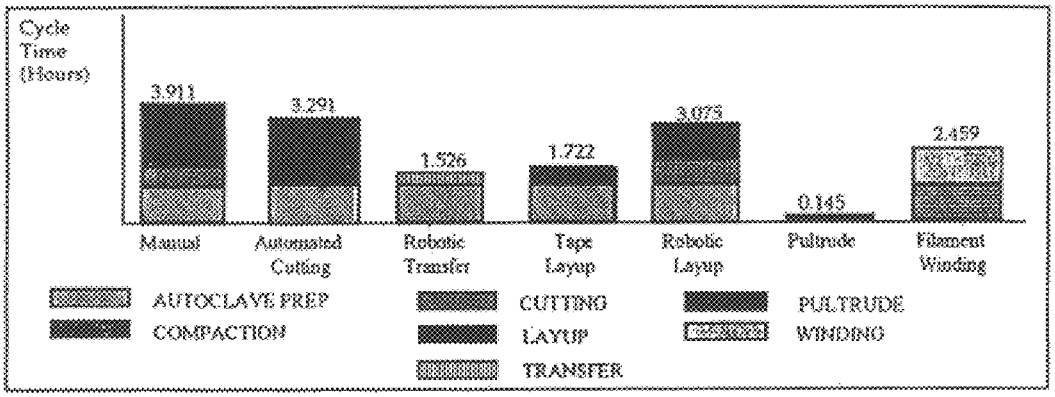
FIG. 4 shows a graphical comparison of composite production technology cycle times.

Several potential manufacturing approaches are positioned between the two processing option extremes discussed above. Of these options, features of pultrusion have been identified to be seen as the core of a pole production line. FIGS. 3 and 4 illustrate the motivation for adapting a highly automated, low cost processing technique such as pultrusion in place of alternative manufacturing technology. FIG. 3 shows the estimated per-panel cost for producing a hypothetical 4 square-foot, hat-stiffened graphite/epoxy aircraft panel using various technologies at an annual rate of 2,000 units per year. The analysis shows that pultruding the baseline part would be at least 2.5 times less costly than filament winding, the next most cost-efficient method in the study and the standard technique for producing the current generation of composite poles. Parts made with prepreg using a variety of hand and automated methods were predicted to be up to 5.5 times more expensive than is pultrusion.

FIG. 4 compares the cycle times for the same processes making the same part. Except for pultrusion, all the production techniques in this study are based on the construction of discrete components using a multi-step procedure. Some or all of the production steps must be individually repeated for each item that is manufactured. Cost of repetitive operations can greatly increase the price of the finished component. Since pultrusion is essentially a single step process flowing continuously from material forming to finished, cured, and cut-to-length parts, it can produce hardware far more rapidly than any other candidate system.

Successfully adapting a low cost manufacturing process to production of a part with the complex set of geometric, cost and performance requirements require a close interaction between the design, analysis, materials selection and process development functions of a program team. To capture the cost savings possible with a technique such as pultrusion, the designer must be knowledgeable of the special advantages and disadvantages of the candidate processes, and must incorporate these constraints at an early stage into the part design process. For example, pultrusion is most efficient at producing 2-D, constant cross section parts that include at least a moderate degree of axially-oriented fiber to give the preform adequate strength to withstand the tensile forces induced during the process. Conversely, filament winding is best at producing parts with a minimum of fibers oriented along the axis of the spinning mandrel, and is not limited to constant cross sections. Resin Transfer Molding (RTM) tends to produce parts with slightly lower fiber volume than pultrusion (typically low to mid 50% with RTM compared to high 50's to high 60's with pultrusion), and therefore must be designed to lower stress levels. RTM can however produce parts with complex three-dimensional geometries. SCRIMP, a lower pressure and lower quality variation of RTM, has received recent publicity because it has been used to construct large products such as composite rail car and bridge deck components. SCRIMP's most attractive feature is its low cost tooling, an important consideration for prototyping. However, this advantage is quickly lost in production because it requires a large amount of recurring labor to position materials in the tool for each part. Life of inexpensive SCRIMP tools may be as few as five parts, so the low cost tooling advantage can be quickly lost in large production.

The close interaction between configuration and production process means that a design optimized for a particular processing option might differ considerably in materials and configuration from process to process. The pultrusion process, for example, is capable of integrating several components into a single unit, while other techniques may require the production and secondary assembly of separate pieces to accomplish the same function. Tailoring component designs to be compatible with particular manufacturing processes could in some cases result in noticeable variations in part details and other important performance-related characteristics.

Identification of the "best" manufacturing approach for a particular part must reflect the factors being emphasized in the part's design. For example, if quantities are small and minimum weight is a dominating concern, a trade study will probably recommend that the part be made primarily by traditional hand-laid, autoclave-cured prepreg techniques, because this process offers the most flexibility for globally tailoring thickness, ply angle, and geometry. It is also unfortunately the most expensive approach. If quantities are reasonable and if some small concession to weight and geometric flexibility can be accommodated, pultruded parts will always produce a major cost savings compared to prepreg/layup parts. The following paragraphs briefly outline some of the characteristics of the pultrusion process.

Figure 5:
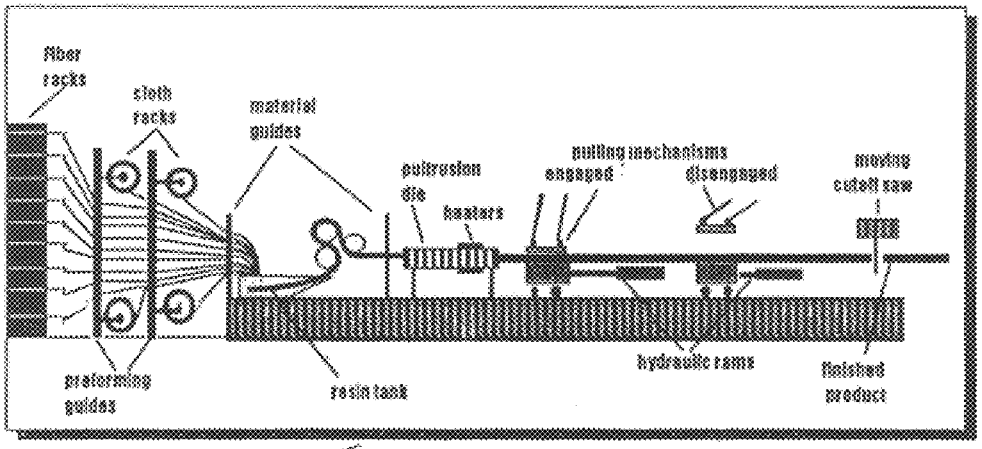
FIG. 5 shows a schematic view of a typical wet-bath pultrusion system.

Pultrusion technology represents the only method currently capable of producing composite parts on a continuous basis and of unlimited length. The process is illustrated schematically in FIG. 5, in this case using a wet bath to impregnate a fiber preform with resin. In the pultrusion process, reinforcing materials in the form of dry unidirectional fibers, cloth, multi-axial stitch bonded materials, braided pre-forms and specially-produced 2-D and 3-D reinforced materials are continuously pulled from spools or woven in-line prior to being passed through an optional preheating furnace. Optionally, pre-pultruded rods may be sandwiched between two layers of sheet material prior to pultrusion. Preheating serves to dry the materials and improve resin wet-out. This collation of dry reinforcing material then passes through several forming cards before entering an approximately one meter long heated steel die. The die compacts the material into the final geometry. For shapes that include a closed cell, such as a hat section stiffener, a box-celled sandwich panel, or a utility pole, tooling includes one long cantilevered mandrel for each closed cell in the design. These free-floating mandrels, often 20 feet or longer in length from their upstream mounting fixture, extend into the closed cavity of the die to form the inner surfaces of the closed cell. Resin is applied to the fiber preform, either by pulling it through a wet-bath, as shown in the figure, or by directly injecting the liquid matrix into the die. Resin injection offers a number of advantages for high performance product production, although it requires more complex tooling and longer development efforts in some cases. The wet fiber/resin assembly is then cured as it moves through the heated section of the die.

Completely cured composite parts are made to flow continuously through the pultrusion system by a pair of moving hydraulic grips which alternate clamping onto and pulling the product from the exit end of the die. Production rates of up to one meter per minute are typical, although for thick sections slower speeds are sometimes used to minimize through-the-thickness thermal gradients that can cause uneven curing or thermal cracking. Finished graphite/epoxy pultrusion, which typically run at about one foot per minute in wall thickness typical of stiffened aircraft panels, can be sold for as little as $30 per pound, approximately 10% of the price of a typical autoclave cured prepreg aerospace structure. Glass/epoxy pultrusions can be made as inexpensively as $2/lb in high volume. Polyester matrix parts can approach $1.00 per pound. In large scale production the price of pultruded hardware approaches to within a small percentage of the raw material cost.

Where a hybrid pole is desired, it is advantageous to provide a composite pole having a slip joint disposed at one end capable of accommodating the severed upper section of a conventional utility pole, particularly a wooden pole, that has utility wires connected to cross-members attached to the upper section. In order to best assemble such hybrid poles and to provide for their strength and stability while in use, it is desired that the severed upper section of the existing pole be fixedly seated in a "bucket" or other structure having a known external geometry, so that the fit between the bucket and the replacement pole can be controlled.

Slip joints of the present invention must withstand a moment of 51,000 ft-lbs., must release on impact if the lower section of the hybrid pole is struck by an errant vehicle, must comprise few pieces, must be easy and quick to install, and must be inexpensive. In addition, the slip joints of the present invention must be capable of accommodating large tolerances between the wood/composite pole interface. Several embodiments of slip joints of the present invention are provided in the following examples.

EXAMPLE 2

Figure 6A:
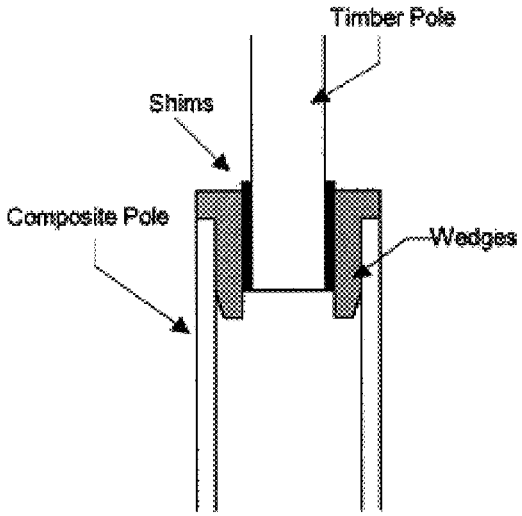
FIG. 6A shows a cross-sectional side view of a slip joint of the present invention having circumferential wedges.
Figure 6B:
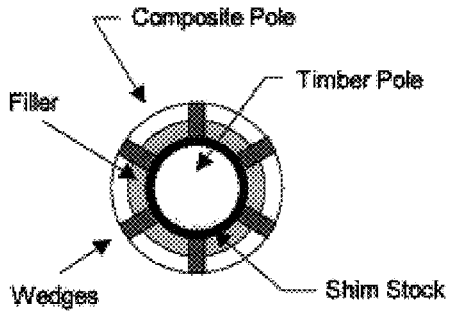
FIG. 6B shows a cross-sectional axial view of the slip joint of FIG. 6A.
Figure 6C:
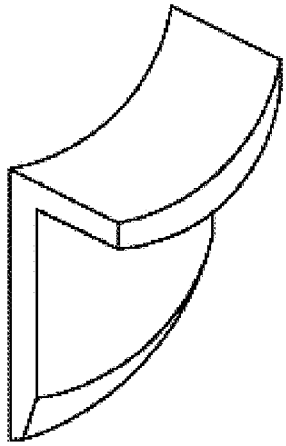
FIG. 6C shows a perspective view of a circumferential wedge of FIG. 6A.

In one embodiment, shown in FIGS. 6A–6B, the slip joint of the present invention comprises a plurality of wedges disposed radially between the composite pole and the existing pole. This wedge design is a mechanical design that uses a press-fit tolerance to provide the holding power between the composite and wood poles while still allowing the wood top to slip out of the composite base. This design could use a number of thin wedges around the circumference to provide the grip force while a filler material may be provided to fill in the vacant spaces between the wedges. Shim stock may be optionally provided to further enhance both installation and release of the pole segments. If the thin wedges prove not to provide a sufficient grip force, the wedge design could then be modified to circumferential wedges or "pie-shaped" wedges. A schematic of the "pie-shaped" wedge design is shown in FIG. 6C.

Method of Installation:

Prior to installation, the top section of the wooden pole is cut from the rest of the damaged pole, forming a "butt" end having a diameter less than the inner diameter of the upper end of the composite pole. The top section of the existing pole is optimally supported by a bucket truck to minimize the strain placed on the utility wires attached thereto. A hole of sufficient diameter to accommodate the lower end of the composite replacement pole is then augured in the ground adjacent to the damaged pole segment and the composite pole is installed in the ground. The diameter of the butt end of the severed upper section of the wooden pole is measured at this time and is shimmed to a nominal dimension by wrapping it with shim material. This shim material is secured to the pole butt by means of nails, staples, screws, or other fastening means.

The wooden pole butt is then inserted some insertion depth into the upper end of the composite pole, and a plurality of wedges are inserted in the gap formed between the outer diameter of the wooden pole and the inner diameter of the composite pole. The wedges are then hammered down until the upper lip of the wedge comes into contact with the top of the composite pole, which ensures proper engagement. Once the wedges have been driven into place, the gaps may then be filled with an expanding filler material. Finally, a tapered collar, optionally sealed with a bead of silicone, may be applied around the top of the joint to allow water and snow to run off. It is also contemplated that, where the geometry permits, a silicone bead may be likewise applied directly to the pole connection interface. Where the existing pole tipper end has been supported by a bucket truck, unhooking the pole from the truck completes the replacement process.

EXAMPLE 3

Figures 7A, 7B:
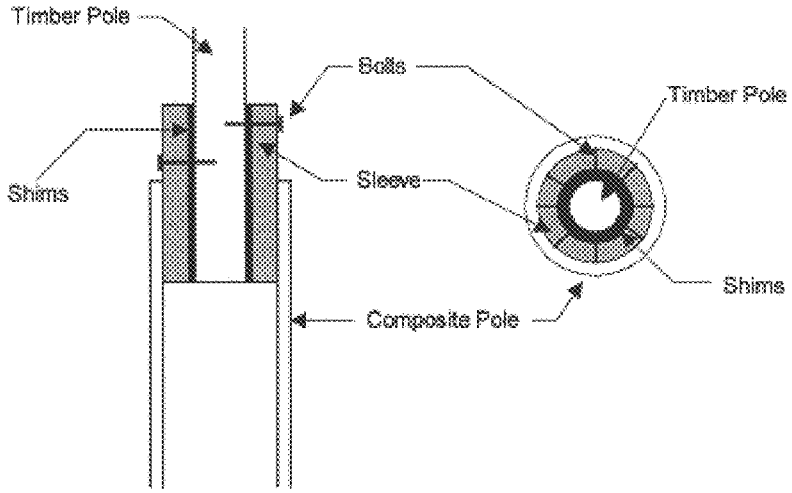
FIG. 7A shows a cross-sectional side view of a slip joint of the present invention having an insertion sleeve.
FIG. 7B shows a cross-sectional axial view of the slip joint of FIG. 7A.

In yet another embodiment, shown in FIGS. 7A–7B, the slip joint of the present invention comprises an insertion sleeve fixed about the butt end of the upper section of the severed existing pole. The sleeve has a fixed inner diameter and outer diameter, the outer diameter matingly corresponding to the inner diameter of the composite replacement pole. In this embodiment, the insertion sleeve serves both to reinforce the joint between the wooden and composite poles, as well as to occupy substantially the volume between the wooden pole and the composite pole. Where the diameter of the existing wooden upper section butt end is less than the inner diameter of the insertion sleeve, shimming material may be used to occupy the void. Because it is permanently attached to the butt end of the existing wooden pole, when the composite pole is impacted, the wooden upper section and sleeve assembly slips out of the composite pole. This design enables the sleeve to be attached to the wooden upper section only once, even if many composite replacement poles are subsequently used due to accidents. In order to facilitate assembly, a lubricant, preferably a volatile lubricant such as a perfluorocarbon, may be applied to the sleeve prior to the insertion of the free butt end into the attachment end.

Method of Installation:

Prior to installation, the top section of the wooden pole is cut from the rest of the damaged pole, forming a "butt" end having a diameter less than the inner diameter of the upper end of the composite pole. The top section of the existing pole is optimally supported by a bucket truck to minimize the strain placed on the utility wires attached thereto. A hole of sufficient diameter to accommodate the lower end of the composite replacement pole is then augured in the ground adjacent to the damaged existing pole and the composite pole is installed in the ground.

The diameter of the existing wooden upper section butt end is measured and then optimally shimmed to a nominal diameter that corresponds to the insertion sleeve inner diameter. This allows the sleeve to be slipped on, drilled, and bolted in place. The sleeve then slides "snuggly" into the composite pole until it hits a positive stop (not shown in FIG.

7A). Where the existing pole upper end has been supported by a bucket truck, unhooking the pole from the truck completes the replacement process.

EXAMPLE 4

Figures 8A, 8B:
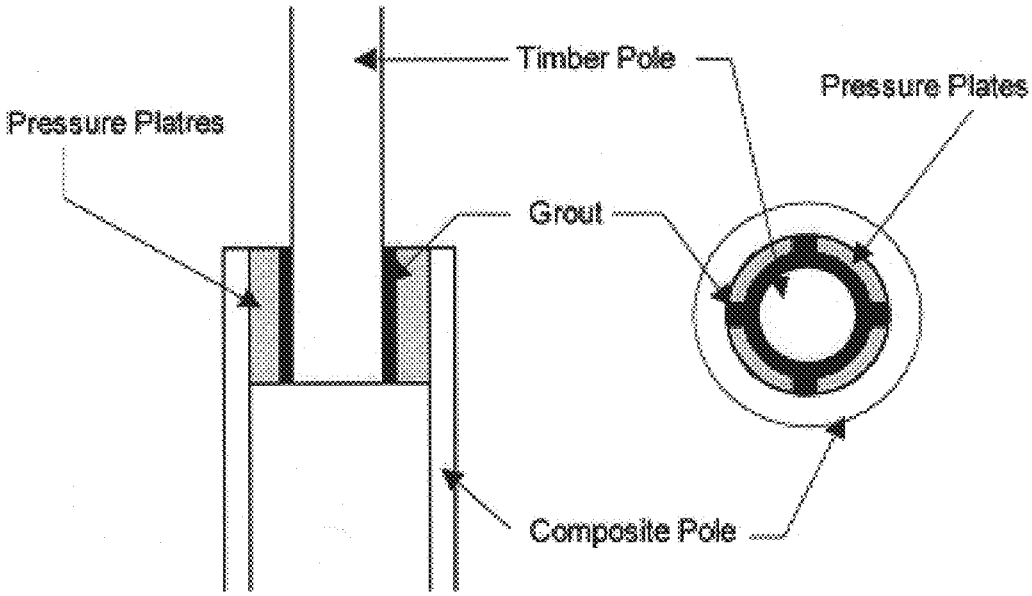
FIG. 8A shows a cross-sectional side view of a slip joint of the present invention having toothed pressure plates.
FIG. 8B shows a cross-sectional axial view of the slip joint of FIG. 8A.
Figure 8C:
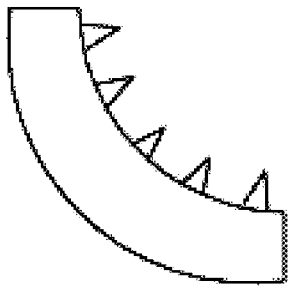
FIG. 8C shows a plan view of a pressure plate of FIG. 8A.

In a further embodiment, shown in FIGS. 8A–8C, the slip joint of the present invention comprises a combination of pressure plates and filler to accommodate the large diametric variation of wooden poles. The pressure plates have teeth on the inner radius to bite into the wooden pole. The filler is used to fill the gap between the wooden pole and the pressure plates to enable wooden poles of various diameters to be inserted into the replacement pole of the present invention. Once the pressure plates are attached using the teeth on their faces and the lag-set screw, the existing pole upper section butt end has the correct outer diameter to be accepted by the composite pole. Through-bolting may also be used to secure the two pole sections.

Method of Installation:

Prior to installation, the top section of the wooden pole is cut from the rest of the damaged pole, forming a "butt" end having a diameter less than the inner diameter of the upper end of the composite pole. The top section of the existing pole is optimally supported by a bucket truck to minimize the strain placed on the utility wires attached thereto. A hole of sufficient diameter to accommodate the lower end of the composite replacement pole is then augured in the ground adjacent to the damaged existing pole and the composite pole is installed in the ground.

Filler is applied to the butt end of the wooden pole upper section. Once a thick layer of filler has been applied, the pressure plates are then hammered onto the pole, such that the teeth pass through the filler layer and into the wooden pole butt end. The teeth, shown in the FIG. 8C, bite into the wood and hold the pressure plates in place. The plates are hammered into the pole until the correct nominal diameter is achieved. This diameter is checked with a go/no-go gage to check the diameter of the wooden pole and pressure plates. At this point a lag-set screw is screwed through the plates into the pole. As the pressure plates are hammered and screwed into the pole, the excess filler migrates out between each plate, and fills the circumferential gaps between the plates. Once the correct diameter is achieved to provide a "snug" fit, the upper wooden pole assembly is slid into the composite pole.

EXAMPLE 5

Figures 9A, 9B:
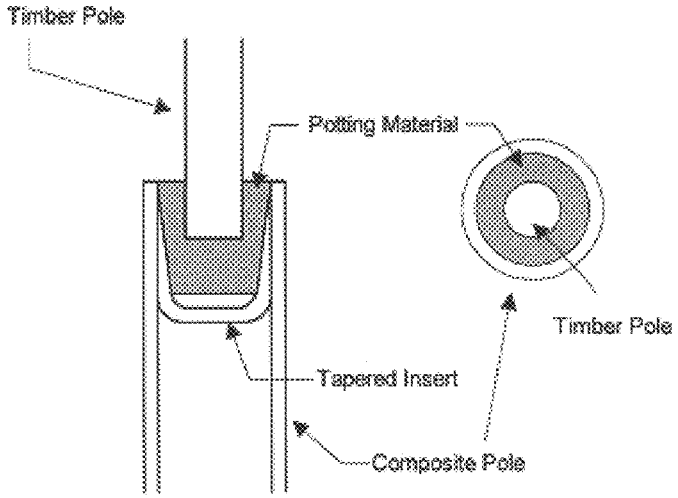
FIG. 9A shows a cross-sectional side view of a slip joint of the present invention having a cast plug.
FIG. 9B shows a cross-sectional axial view of the slip joint of FIG. 9A.

In yet another embodiment, shown in FIGS. 9A–9B, the slip joint of the present invention comprises a cast plug disposed within a tapered insert that is fixedly disposed within the upper end of the composite pole. This embodiment contemplates a chemically formulated plug adhered to the wooden pole in the form of a taper. This taper matingly corresponds with the tapered composite pole insert. In addition to supplying the correct geometry to accept the tapered plug, the tapered insert provides hoop reinforcement for the composite pole, as well. A mechanical fastener capable of withstanding the applicable forces secures the plug within the insert until the release force is realized.

Method of Installation:

Prior to installation, the top section of the wooden pole is cut from the rest of the damaged pole, forming a "butt" end having a diameter less than the inner diameter of the upper end of the composite pole. The top section of the existing pole is optimally supported by a bucket truck to minimize the strain placed on the utility wires attached thereto. A hole of sufficient diameter to accommodate the lower end of the composite replacement pole is then augured in the ground adjacent to the damaged existing pole and the composite pole is installed in the ground.

When the composite pole is delivered to the customer, the tapered insert is already in place and the pole is ready to accept a corresponding tapered plug. The casting material is mixed in a bucket having the desired geometric shape of the tapered plug. The filled bucket is then placed over the butt end of the wooden pole upper section and attached thereto with bolts or some other type of mechanical fastener. The casting material cures in place in a short period of time and then the bucket is either taken off or left in place (depending on the casting material used). The wooden pole upper section having the tapered plug fixed to the butt end thereof is then dropped into the tapered insert of the composite pole. The tapered plug is then fixed within the tapered insert via a mechanical connection device. Where the existing pole upper end has been supported by a bucket truck, unhooking the pole from the truck completes the replacement process.

These are just some of the embodiments of the present invention that are contemplated. The wedge embodiment provides a pure mechanical joint where the fit between the composite pole, wedge, and wooden pole provides the correct axial, bending, and torsional resistance for pullout. The sleeve joint embodiment is another mechanical joint, where the sleeve occupies the space between the two poles and uses a snug fit to meet the performance specifications. The cast plug embodiment is a combination mechanical/chemical joint to allow for the correct geometry for slip-out, while still maintaining the correct rigidity to withstand the specified force moments. Finally the pressure plate design is a mechanical/chemical joint which also required a snug fit to meet the moment specifications, while still slipping out during an impact.

EXAMPLE 6

The cast plug embodiment of Example 5 requires casting materials capable of meeting several critical objectives. First, the casting material must be easily prepared by non-specialized personnel. Second, it must rapidly cure or at least initial set-up. Third, when cured, its mechanical properties must be sufficient to support bending loads. Fourth, it must be low in cost in terms of both materials and mixing/installation labor. Fifth, it must exhibit low moisture absorption and environmental degradation. Finally, it must exhibit a longevity of over twenty years in field conditions.

A variety of resins and resin/filler combinations have been examined, including combinations with asphalt. Although inexpensive, polyester resins provide relatively poor strength and environmental durability. Epoxies, although more expensive, provide excellent mechanical properties. A good compromise between expense and performance is a filled vinyl ester resin, which provides excellent strength, stiffness, and environmental robustness.

The key to the success of the plug design (or any concept using a potting or filler material to stabilize the joint) is the idea of having a material that will setup and at least partially cure in a relatively short period of time (e.g., minutes rather than hours). The environmental conditions experienced by the installation crew while mating the composite replacement pole and the timber top are anything but ideal for mixing 2-part adhesives or potting materials. The installation must take place in any kind of weather condition, including sun, rain, snow, hot days, or cold nights. The mating process for the two sections of the pole must be quick.

Figures 10A, 10B:
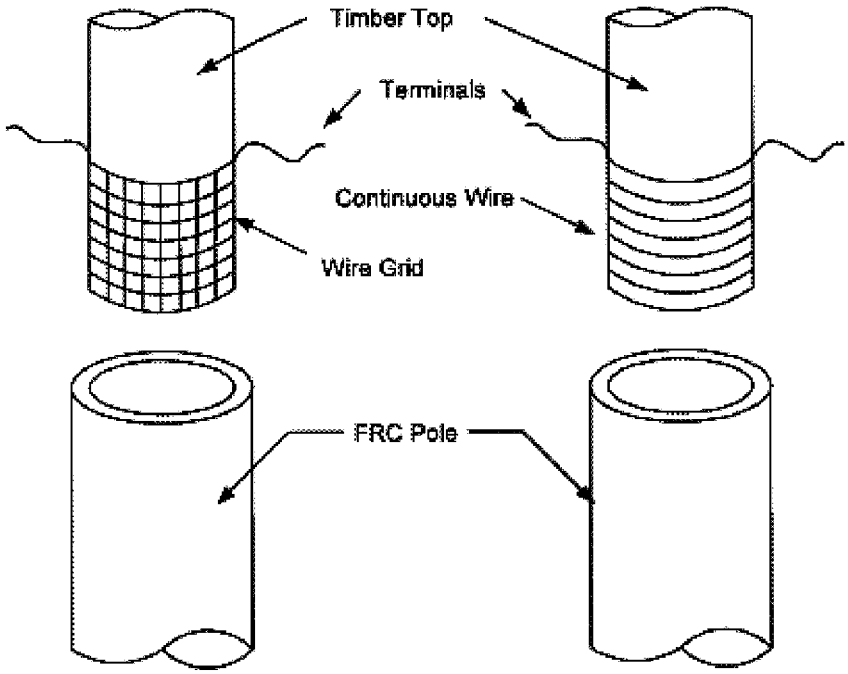
FIG. 10A shows a resistance-wire heating method of curing the cast plug of FIG. 9 using a wire grid.
FIG. 10B shows resistance-wire heating method of curing the cast plug of FIG. 9 using a continuous, wound wire.

Three methods to speed up the potting material curing process that employ electric resistance heating to "kick" and/or cure the polymeric resin in such materials include heating the material with a continuous wire or grid, as shown in FIG. 10, using conductive fillers to make the material itself conductive, and blanket-wrapping the joint to apply heat.

The heat generated in a wire grid can be quite large if the resistance of the wire is high or the current running through the wire is large. If, as seems likely, the thermal conductivity of the potting material were small, then the density and coverage of the wire grid or path must be tailored to provide the requisite threshold energy over the entire volume of potting. This volume may be fairly large, and it would take a long time to heat the large annulus (e.g., approximately one inch between wood and composite) with sparse heating element coverage. The characteristics of available electric power (e.g., truck alternator voltage and current capacity) must of course be evaluated to properly assess electrically cured approaches to the potting problem One result from preliminary tests using the continuous wire or grid was very localized heating around the wires. For a joint that has an annulus of approximately one inch, the wires would cure the material locally, but the remaining material would be unaffected. This suggested that the potting material had too-low a thermal conductivity. Therefore, it is desired that a conductive filler material, such as chopped carbon fiber or powder, be used to achieve a faster, more uniform curing of the potting material.

The density, strength, and cost of the potting material is dependent on the type and proportions of various fillers and additives that may be desirable to add. Sand is a cheap bulking agent, albeit very heavy. Fly ash residue has a large weight-specific surface area, excellent bonding to polymer resins, low density, and good strength. Recycled thermoplastic beads, such as polyethylene/polypropylene, provide a low-density filler with some useful wetting characteristics. Chopped carbon fiber or powder increases electrical/thermal conductivity, assisting the electrically-cured resin approach. UV inhibitors minimize aging degradation.

The actual cost of the potting material once the filler is added is difficult to estimate because it is dependent on the type of filler. Some fillers might not require the same amount as another to reach the same conductivity. Consider a chopped carbon filler, one fiber might cross 4 or 5 other fibers in a unit volume. Using milled carbon fillers and the same density, the carbon particles might not even touch, therefore resulting in a lower conductivity than the fiber filler. It might take 3 times as much milled carbon to equal the conductivity of chopped carbon filler in the potting material.

Figure 11:
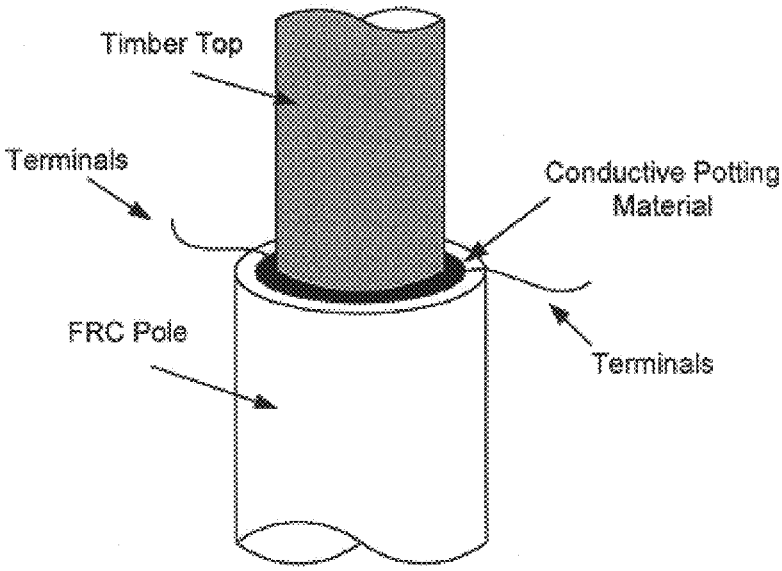
FIG. 11 shows an assembled pole assembly that has been provided with resistance-wire heating means according to FIGS. 10A and 10B.

FIG. 11 shows a schematic of a joined pole. The terminals are used to transfer low voltage electricity into the conductive potting material. The goal of the potting material is to cure under an hour while requiring a minimum of input voltage. The input voltage should be no more than what can be supplied by the typical utility truck.

Using a continuous wire heating element provided local heating and cured the potting material right around the wire within a few minutes. However, the potting material was too viscous, therefore leaving large gaps around the pole. These gaps leave nonconductive areas resulting in spots that do not cure. The less viscous the potting material, the easier it is to fill in all the gaps between the timber top and the FRC bottom. Filling in all the areas is essential for both a conductive and strong joint.

EXAMPLE 7

Bending tests were conducted on a 40-foot class 3 utility pole. To validate the use of hybrid wood and fiber-reinforced composite (FRC) poles, they must meet the bending test as described in ASTM 1036-98. To meet the specifications of a class 3 pole, the hybrid must carry a 3000-pound tip load, which simulates loading conditions in adverse weather conditions.

Figure 12:
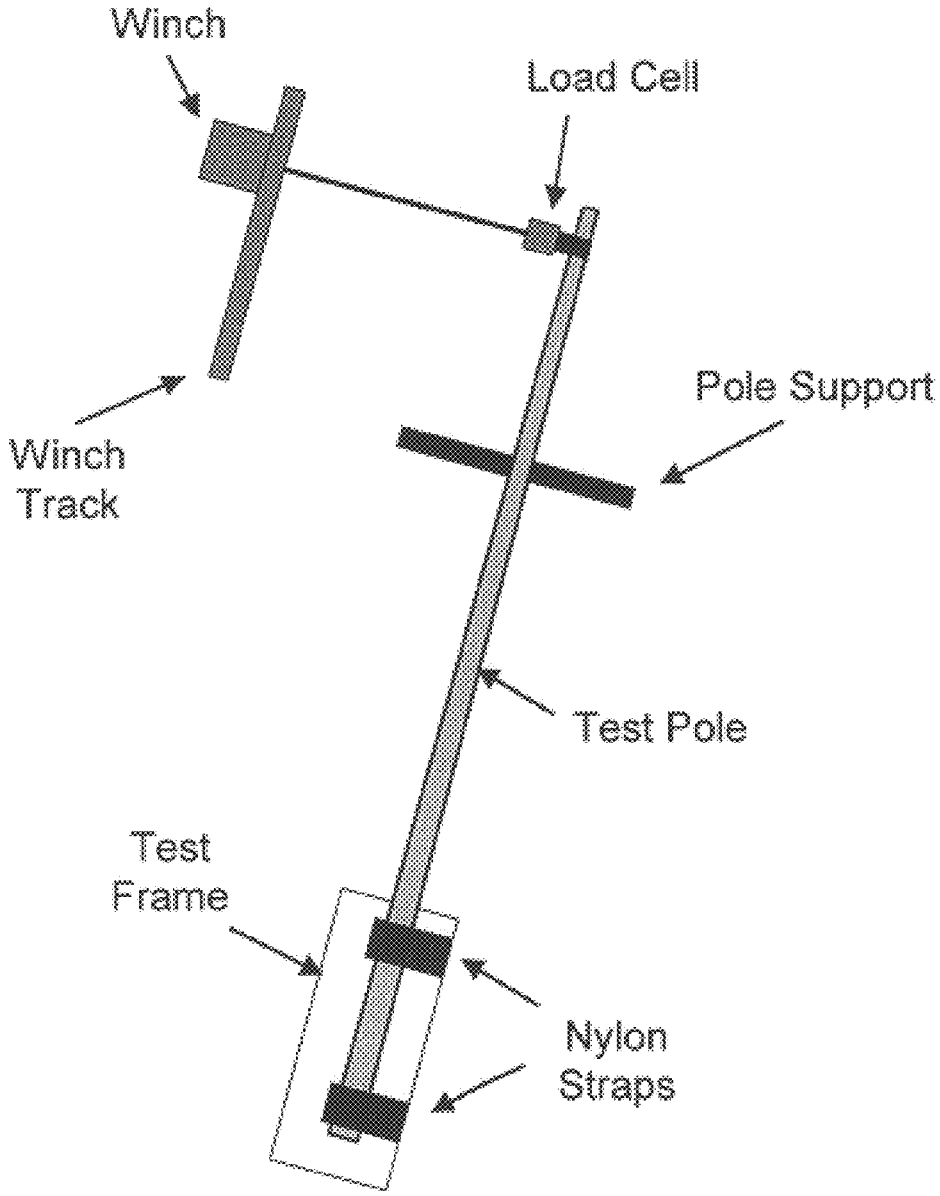
FIG. 12 shows a static pole test apparatus.

As shown in FIG. 12, the testing equipment included a pole test frame, loading winch, load cell, deflection measurement sensors and a computerized data acquisition system.

The poles were tested in a horizontal cantilever arrangement. The butt of the pole was held in a rigid test frame using two 12-inch wide nylon straps. The pole was supported at approximately 10 feet from the tip to balance the weight of the cantilevered section of the pole. The load cell was attached two feet from the tip using a nylon sling. The cable of the winch was then attached to the load cell via a shackle. The load was applied at a constant rate of displacement using an electric drive winch. The loading at the tip, deflections at the tip, joint and butt were recorded from initial loading until final failure of the pole. The deflections recorded at the butt were used to adjust the deflections at the joint and tip for any rotation of the pole in the test frame. The test yielded the ultimate failure load, as well as the bending stiffness of the hybrid pole.

Three poles were tested. Slight variations in the construction of each pole demonstrates the importance of such parameters as rod surface treatment, number of skins, type of filler and reinforcement methods. The construction parameters of the three poles are given in Table 1.

TABLE 1

| Item Description | Pole #2 | Pole #3 | Pole #4 |
|---|---|---|---|
| Pole Length | 25 ft. | 25 ft. | 25 ft. |
| Inner Laminate | Q-2408 | Q-2408 | 2x Q-2408 |
| Fabric Orientation | 45/−45/Random | 45/−45/Random | 45/−45/Random |
| Fabric Wt. (oz/yd$^2$) | 12/12/08 | 12/12/08 | 24/24/16 |
| Thick @ 40% $V_f$ (in.) | 0.042 | 0.042 | 0.084 |
| Resin (lb.) | 27 | 27 | 54 |
| Rods | 0.375" | 0.375" | 0.375" |
| Surface Prep | As Cut | As Cut | Sanded/Wiped |
| Number of Rods | 100 | 100 | 101 |
| Resin (lb.) | 34 | 34 | 34 |
| Filler | CaCo3 | Clay | Clay |

TABLE 1-continued

| Item Description | Pole #2 | Pole #3 | Pole #4 |
|---|---|---|---|
| Outer Laminate | Q-2408 | Q-2408 | 2x Q-2408 |
| Fabric Orientation | 45/−45/Random | 45/−45/Random | 45/−45/Random |
| Fabric Wt. (oz/yd$^2$) | 12/12/08 | 12/12/08 | 24/24/16 |
| Thick @ 40% $V_f$ (in.) | 0.042 | 0.042 | 0.084 |
| Resin (lb.) | 27 | 27 | 54 |
| Added Reinforcement | | | |
| Fabric | 4x NEWCC 1710/01 | 6x NEFC 1210/C | 4x NEWCC 1710/01 |
| Fabric Orientation | 75/−75/Random | 90/Random | 75/−75/Random |
| Fabric Wt. (oz/yd$^2$) | 34/34/40 | 72/54 | 34/34/40 |
| Thick @ 40% $V_f$ (in.) | 0.142 | 0.165 | 0.142 |
| Location | Entire Length | 6.5 feet @ Butt<br>3 feet @ Tip | 6.5 feet @ Butt<br>3 feet @ Tip |
| Comments | 1) Sun-cured<br>2) Heat-cured after three days | 1) Heat-cured the following day<br>2) Added layers tended to wrinkle | 1) Heat-cured the same day<br>2) Rods sanded and wiped with acetone |

Table 2 summarizes the construction parameters of the three poles that were tested. The first pole tested, pole 2, did not meet the required load of 3000 pounds. The pole failed at 2630 pounds with a max displacement of 57.8 inches. The failure of the pole occurred at 15.6 inches from the groundline. At the failure load, the pole buckled on the compressive side and changed cross section to an oval, from a circle.

Pole #3 was tested with similar results, it failed the test and the rods debonded from the inner and outer skins. This pole however, failed at a lower load of 1760 pounds with a max displacement of 33.7 inches.

Figure 13A:
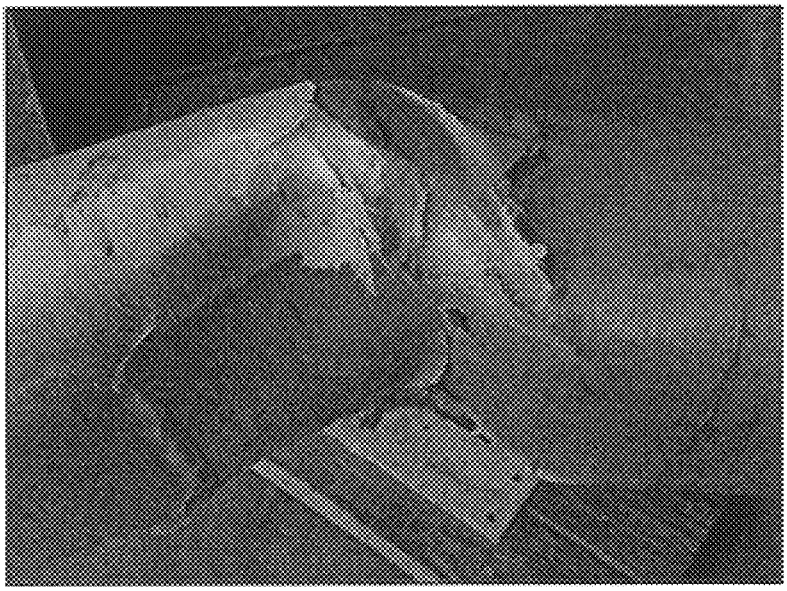
FIG. 13A shows the failure result of a pole that meets the objectives of the present invention.
Figure 13B:
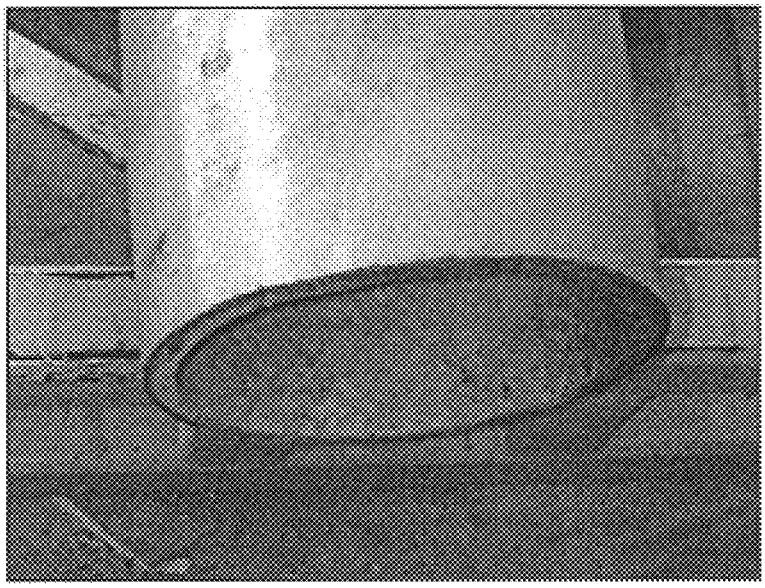
FIG. 13B shows the butt end of the pole of FIG. 13A.

Pole #4 passed the Class 3 load test, carrying a bending load of 4990 pounds with a max displacement of 91.1 inches. This pole is the only pole that the rods did not debond from the skins, and it also is the only pole that used sanded and cleaned rods. The failure and the butt end of pole #4 are seen in FIGS. 13A and 13B, respectively. Table 3 summarizes the results for the three poles that were tested.

TABLE 2

| Pole | Rod Treatment | # of Skins | Filler | Reinforcement |
|---|---|---|---|---|
| 2 | None | 1 | Calcium Carbonate | Whole Pole |
| 3 | None | 1 | Clay | Butt and Joint |
| 4 | Sanded and Cleaned | 2 | Clay | Butt and Joint |

*Pole 1 was used for process development and was not suitable for testing.

TABLE 3

| Pole | Failure Load (lbs) | Joint Deflection (inches) | Tip Deflection (inches) | Comments |
|---|---|---|---|---|
| 2 | 2630 | 13.76 | 57.79 | Compressive failure just above groundline. |
| 3 | 1760 | 8.23 | 33.73 | Compressive failure approximately 3 feet above groundline. |
| 4 | 4990 | 19.64 | 91.12 | Compressive failure immediately above groundline. |

One reason that pole 4 passed the test for class 3 utility poles, is that the rods were sanded and cleaned prior to assembly of Pole 4. Looking at FIG. 13B shows that the rods did not debond from skins as occurred with the previous poles. The improved adhesion between the rods and the matrix material helped prevent the buckling of the rods. Sanding and cleaning the rods allowed for better adhesion to the matrix material, and considerably improved pole strength.

Another reason that pole #4 passed the Class 3 test is that the pole was constructed of 2 inner and 2 outer skins. Bending the pole resulted in the compression of some of the rods, subsequently forcing them to buckle. With 2 inner layers, the buckling tendency required a higher load, therefore resulting in a higher bending strength.

Looking at Table 2, pole #2 was reinforced over the whole length, instead of just at the joint and butt. Reinforcement is necessary at the joint and butt in order for the pole to withstand local stress concentrations resulting from the socket joint and the groundline. However, comparing poles #2 and #4, provided that two skins are used, reinforcements only at the butt and joint is more than sufficient for the pole to withstand the static bending loads to be expected during normal use.

While the present invention has been described in terms of specific methods and compositions, it is understood that variations and modifications will occur to those skilled in the art upon consideration of the present invention. Numerous modifications and variations in the invention as described in the above illustrative examples are expected to occur to those skilled in the art.

What is claimed is:

1. A utility pole comprising:

a lower pole element comprising a hollows pultruded pole having an open upper end defining an inner cross-sectional area, and a lower end fixable in ground;

an upper pole element having a severed lower end having an outer diameter sized to be smaller than and to fit within the inner cross-sectional area of the open upper end of the lower pole element, the upper pole element further including at least one utility wire attachment member configured to support one or more utility wires above the severed lower end; and a joint assembly fixable within the open upper end of the lower pole element and sized to receive the severed lower end of the upper pole element to support the upper pole element.

2. The utility pole of claim 1, wherein the joint assembly comprises a slip joint.

3. The utility pole of claim 1, wherein the joint assembly is configured to release the upper pole element from the lower pole element upon an impact on the lower pole element having a determined minimum force.

4. The utility pole of claim 1, wherein the joint assembly comprises a tapered insert seated within the open upper end and a tapered cast plug disposed about the severed lower end and fixed within the tapered insert.

5. The utility pole of claim 1, wherein the joint assembly comprises a plurality of wedge members disposed circumferentially within the open upper end of the lower pole element and about the outer diameter of the severed lower end.

6. The utility pole of claim 5, wherein each of the wedge members comprises an arcuately curved element.

7. The utility pole of claim 5, wherein each of the wedge members further includes an upper radially outwardly extending lip configured to abut an upper surface of the open upper end of the lower pole element.

8. The utility pole of claim 5, wherein the joint assembly further comprises one or more shim members between the wedge members and the severed lower end.

9. The utility pole of claim 1, wherein the joint assembly comprises a sleeve having an outer surface sized to mate with an inner surface of the open upper end of the lower pole element, the severed lower end fixed within the sleeve.

10. The utility pole of claim 9, wherein the joint assembly further comprises a stop member fixed within the lower pole element to limit travel of the sleeve within the lower pole element.

11. The utility pole of claim 1, wherein joint assembly further comprises a plurality of arcuate plate members disposed circumferentially within the open upper end of the lower pole element and about the outer diameter of the severed lower end, the plate members further including a plurality of inwardly directed teeth disposed to affix to the severed lower end of the upper pole element, and a filler material disposed within gaps between the plate members and the severed lower end.

12. The utility pole of claim 1, wherein the pultruded pole comprises a plurality of prepultruded rods circumferentially arranged between an inner skin and an outer skin.

13. The utility pole of claim 1, wherein the upper pole element comprises a wooden pole.

14. The utility pole of claim 1, wherein the lower pole element has a diametric crush strength sufficient to initiate a flattening and folding response upon an impact of a vehicle into the lower pole element.

15. A method of replacing a damaged wooden utility pole having a lower damaged pole segment and an upper pole segment carrying a utility wire connection structure, the method comprising the steps of:

severing the damaged pole segment from the upper pole segment at a point below the utility wire connection structure to form a severed lower end of the upper pole segment;

installing a replacement pole comprising a hollow, pultruded pole having an open upper end defining an inner cross-sectional area greater than an outer diameter of the severed lower end, and a lower end, by fixing the lower end of the replacement pole in ground adjacent the damaged pole segment; and inserting the severed lower end of the upper pole segment into a joint assembly fixed within the open upper end of the lower pole element and sized to receive the severed lower end of the upper pole element to support the upper pole element.

16. The method of claim 15, wherein in the inserting step the joint assembly comprises a slip joint.

17. The method of claim 15, wherein in the inserting step the joint assembly is configured to release the upper pole element from the lower pole element upon an impact on the lower pole element having a determined minimum force.

18. The method of claim 15, wherein in the inserting step the joint assembly comprises a tapered insert seated within the open upper end and a tapered cast plug disposed about the severed lower end and fixed within the tapered insert.

19. The method of claim 15, wherein in the inserting step the joint assembly comprises a plurality of wedge members disposed circumferentially within the open upper end of the lower pole element and about the outer diameter of the severed lower end.

20. The method of claim 19, wherein in the inserting step the joint assembly further comprises one or more shim members between the wedge members and the severed lower end.

21. The method of claim 15, wherein in the inserting step the joint assembly comprises a sleeve having an outer diameter sized to mate with an inner surface of the open upper end of the lower pole element, the severed lower end fixed within the sleeve.

22. The method of claim 21, wherein in the inserting step the joint assembly further comprises a stop member fixed within the lower pole element to limit travel of the sleeve within the lower pole element.

23. The method of claim 15, wherein in the inserting step the joint assembly further comprises a plurality of arcuate plate members disposed circumferentially within the open upper end of the lower pole element and about the outer diameter of the severed lower end, the plate members further including a plurality of inwardly directed teeth disposed to affix to the severed lower end of the upper pole element, and a filler material disposed within gaps between the plate members and the severed lower end.

* * * * *

UNITED STATES PATENT AND TRADEMARK OFFICE

CERTIFICATE OF CORRECTION

PATENT NO. : 6,397,545 B1 
DATED : June 4, 2002
INVENTOR(S) : Jerome P. Fanucci et al.

It is certified that error appears in the above-identified patent and that said Letters Patent is hereby corrected as shown below:

Title page,
Item [57], ABSTRACT,
Line 9, "encounter," should read -- encounters --;

Column 1,
Line 23, "cos:t" should read -- cost --;

Column 3,
Line 59, "truck:" should read -- truck --;

Column 5,
Line 54, "even e" should read -- event, the --;

Column 10,
Line 23, "tipper" should read -- upper --;

Column 16,
Line 32, "hollows" should read -- hollow, --;

Column 17,
Line 33, "wherein joint" should read -- wherein the joint --.

Signed and Sealed this

First Day of July, 2003

JAMES E. ROGAN
*Director of the United States Patent and Trademark Office*